US009665029B2

(12) United States Patent
Hino et al.

(10) Patent No.: US 9,665,029 B2
(45) Date of Patent: May 30, 2017

(54) ELECTRO-CONDUCTIVE ROLLER AND METHOD OF MANUFACTURING THE SAME

(71) Applicant: CANON KABUSHIKI KAISHA, Tokyo (JP)

(72) Inventors: Tetsuo Hino, Yamato (JP); Kazuhiro Yamauchi, Suntou-gun (JP); Masaaki Shibata, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 92 days.

(21) Appl. No.: 14/666,248

(22) Filed: Mar. 23, 2015

(65) Prior Publication Data

US 2015/0198907 A1 Jul. 16, 2015

Related U.S. Application Data

(63) Continuation of application No. PCT/JP2014/004866, filed on Sep. 24, 2014.

(30) Foreign Application Priority Data

Sep. 27, 2013 (JP) ..... 2013-202658

(51) Int. Cl.
*G03G 15/02* (2006.01)
*D01D 5/00* (2006.01)

(52) U.S. Cl.
CPC ..... *G03G 15/0233* (2013.01); *D01D 5/0007* (2013.01); *D10B 2401/16* (2013.01)

(58) Field of Classification Search
CPC ..... G03G 15/0233; G03G 15/02; G03G 15/0818; G03G 15/1685; G03G 15/14; D01D 5/0007; F16C 13/00; D10B 2401/16; Y10T 428/2495
USPC ..... 29/895.211
See application file for complete search history.

(56) References Cited

U.S. PATENT DOCUMENTS 3,245,381 A * 4/1966 Brenneisen et al. . G03G 15/102 118/249
3,999,515 A 12/1976 Weiler
5,790,926 A * 8/1998 Mizoe ..... G03G 15/0233 361/221

(Continued)

FOREIGN PATENT DOCUMENTS

JP 6-130793 A 5/1994
JP 6-282160 A 10/1994

(Continued)

OTHER PUBLICATIONS

International Preliminary Report on Patentability, International Application No. PCT/JP2014/004866, Mailing Date Apr. 7, 2016.

*Primary Examiner* — Jason L Vaughan
(74) *Attorney, Agent, or Firm* — Fitzpatrick, Cella, Harper & Scinto

(57) ABSTRACT

An electro-conductive roller, such as a charging roller, that can reduce abnormal electrical discharge in the axial direction of the roller and pinhole leak and be resistant to degradation in electrical characteristics even with long-term use, and a method of manufacturing the same, are provided. In an electro-conductive roller including fibers having electrical conductivity and arranged with no gap in the identical direction on the outer periphery surface of a mandrel, polymer fibers are adopted as the fibers.

6 Claims, 2 Drawing Sheets

(56) References Cited

U.S. PATENT DOCUMENTS

| | | | | |
|---|---|---|---|---|
| 8,257,641 | B1 | 9/2012 | Qi et al. | |
| 9,234,300 | B2 * | 1/2016 | Law | D01D 5/0007 |
| 2010/0291182 | A1 * | 11/2010 | Palasis | A61K 9/0024 424/426 |
| 2010/0297906 | A1 * | 11/2010 | Steckl | D01D 5/0084 442/347 |
| 2012/0224897 | A1 * | 9/2012 | Qi | B82Y 30/00 399/333 |
| 2014/0221184 | A1 | 8/2014 | Arimura et al. | |
| 2014/0287899 | A1 | 9/2014 | Nishioka et al. | |
| 2015/0198900 | A1 | 7/2015 | Yamada et al. | |
| 2015/0198906 | A1 | 7/2015 | Yamauchi et al. | |

FOREIGN PATENT DOCUMENTS

| | | | |
|---|---|---|---|
| JP | 8-234538 | A | 9/1996 |
| JP | 2000-356889 | A | 12/2000 |
| JP | 2004-286084 | A | 10/2004 |
| JP | 2012-167417 | A | 9/2012 |

* cited by examiner

PRIOR ART

ELECTRO-CONDUCTIVE ROLLER AND METHOD OF MANUFACTURING THE SAME

CROSS-REFERENCE TO RELATED APPLICATIONS

This application is a continuation of International Application No. PCT/JP2014/004866, filed Sep. 24, 2014, which claims the benefit of Japanese Patent Application No. 2013-202658, filed Sep. 27, 2013.

BACKGROUND OF THE INVENTION

Field of the Invention

The present invention relates to an electro-conductive roller, such as a charging roller, for applying a voltage to perform a process of charging, to a predetermined potential, a surface of an electrophotographic photosensitive member that is a body to be charged, and to a method of manufacturing the same.

Description of the Related Art

In recent years, in an electrophotographic image forming apparatus (electrophotographic apparatus), usage environments and print medium qualities have been diversified, and high quality has been further requested. An electro-conductive roller, such as a charging roller, in a charging device has been energetically developed and improved.

Japanese Patent Application Laid-Open No. H08-234538 discloses a charging roller in a charging device. As illustrated in FIG. 3, this charging roller 100 includes an electro-conductive roller body 104 (or a blade-shaped body or a pad-shaped body) that includes a conductive core metal 101 connected to a power source device via an electrode terminal 102. A thread member 103 composed of an insulative material is wound on the circumferential surface of the roller body 104 at certain intervals to form convexities. Furthermore, one or more low resistive conductive wire-shaped electrode members, such as tungsten wires, gold wires or copper wires, having a smaller diameter than that of the insulative thread member are arranged alternately with the insulative thread member 103, thereby forming an electrode body.

When such a charging roller is pressed against and in contact with an image forming member (photosensitive member), the thread insulative member serves as a spacer.

SUMMARY OF THE INVENTION

Unfortunately, the charging roller described in Japanese Patent Application Laid-Open No. H08-234538 sometimes causes the following problems in the case of application to an electrophotographic apparatus in practical use.

1) Controllability to electrical resistance and current tends to be low.

More specifically, abnormal electrical discharge in the axial direction of the charging roller and pinhole leak sometimes occur. As a result, the occurrence may limit improvement in image quality in the electrophotographic apparatus.

2) The roller tends to be disadvantageous to long-term use. More specifically, in some cases, toner and additional agent accumulate on concavities on the outer periphery surface of the charging roller (e.g., the surface of electrode body), and reduce the electrical characteristics of the charging roller. As a result, the discharge characteristics may decrease in the case of application to an electrophotographic apparatus.

Abnormal electrical discharge and pinhole leak are hereinafter described in detail.

Electrophotographic steps include a charging step of causing a charging roller to apply a potential to a body to be charged (photosensitive member) made of photosensitive (photoconductive) material. The body to be charged sometimes has fine concavities (pinholes) of less than a millimeter that cause no image failure in usual cases. When a significantly large amount of current flows into the concavities, the charges sometimes flow also into surroundings of the concavities to cause image failure in units of several millimeters, which are multiple times larger than the sizes of concavities. In severe cases, image failure occurs where charges flow to the opposite ends of the body to be charged in the axial direction to form a lateral line on an image. The lower the electrical resistance of the electro-conductive roller is, the easier a large amount of current flows. It is thus known that the lower the electrical resistance of the electro-conductive roller is, the easier such abnormal electrical discharge and pinhole leak occur.

The present invention has been made to address these problems. The present invention is directed to providing an electro-conductive roller, such as a charging roller, that can reduce abnormal electrical discharge in the axial direction of the roller and pinhole leak and be resistant to degradation in electrical characteristics even with long-term use, and a method of manufacturing the same.

According to one aspect of the present invention, there is provided an electro-conductive roller comprising a mandrel, and a fiber having an electro-conductivity, the fiber covering a peripheral surface of the mandrel, and being aligned in an identical direction on the peripheral surface of the mandrel with free of gap, and the fiber being a polymer fiber.

According to another aspect of the present invention, there is provided a method of manufacturing the electro-conductive roller, comprising a step of fabricating the polymer fibers by an electrospinning method.

According to the present invention, an electro-conductive roller, such as a charging roller, that can reduce abnormal electrical discharge in the axial direction of the roller and pinhole leak and be resistant to degradation in electrical characteristics even with long-term use, and a method of manufacturing the same can be provided.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

<Electro-Conductive Roller>

An electro-conductive roller of the present invention is hereinafter described.

The electro-conductive roller of the present invention comprises fibers that have electrical conductivity, are arranged in the identical direction (same direction) on the outer periphery surface of a mandrel and cover the outer periphery surface with no gap. That is, a cover layer made of the fibers having electrical conductivity is formed on the outer periphery surface of the mandrel.

In the present invention, "with no gap" represents a state where the surface of the mandrel is covered with the fibers having electrical conductivity so not to form any gap that allows direct discharge from the surface of the mandrel to a member to be charged in the case of adopting an electro-conductive member of the present invention as the charging member.

The cover layer may contain electro-conductive fibers and be wrapped in the identical direction (same direction) around the outer periphery surface of the mandrel. Alternatively, this layer may be made of electro-conductive fibers wound in the identical direction (same direction) on the outer periphery surface of the mandrel. In the present invention, polymer fibers having electrical conductivity are adopted as the fibers having electrical conductivity. Hereinafter, the polymer fibers having electrical conductivity are sometimes called electro-conductive polymer fibers or polymer fibers. The cover layer of the electro-conductive polymer fibers provided on the outer periphery surface of the mandrel forms an electrode layer. This layer may be the outermost layer (surface layer) of the electro-conductive roller. The orientation direction of the mandrel of the electro-conductive polymer fibers on the outer periphery surface may be any direction intersecting with the axial direction of the mandrel. In a desirable case, the fibers are arranged in a direction substantially perpendicular to the axial direction of the mandrel; i.e., the desirable direction may be the circumferential direction of the mandrel.

The electro-conductive roller can be used for roller members in an image forming apparatus used for various usages, such as development, charging, transfer (toner supply, cleaning). The electro-conductive roller can be used as an electro-conductive roller for electrophotography adopted in an electrophotographic apparatus. In particular, this roller can be used as a charging roller for charging a photosensitive member.

Figure 1A:
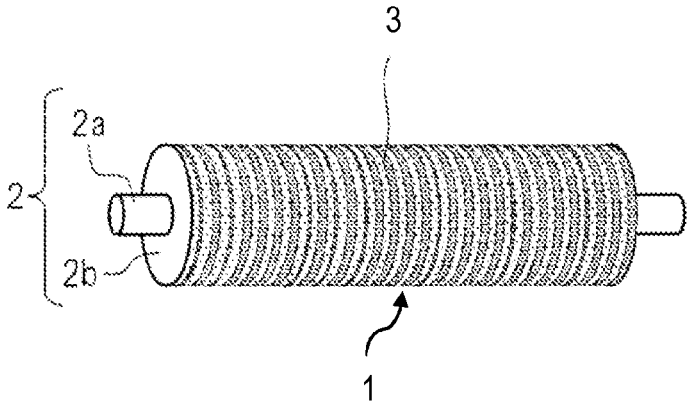
FIG. 1A is a schematic perspective view of an example of an electro-conductive roller of the present invention.
Figure 1B:
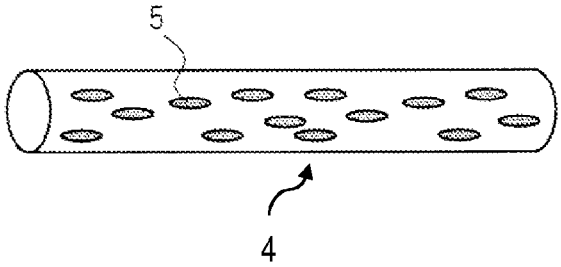
FIG. 1B is a schematic perspective view of an example of one conductive polymer fiber that contains electro-conductive filler.
Figure 1C:
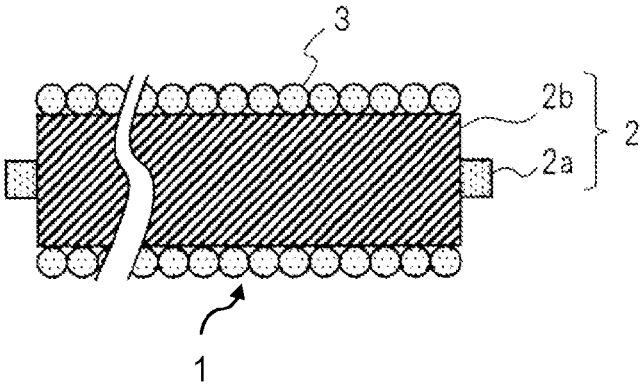
FIG. 1C is a schematic sectional view of the example of the electro-conductive roller illustrated in FIG. 1A.
Figure 1D:
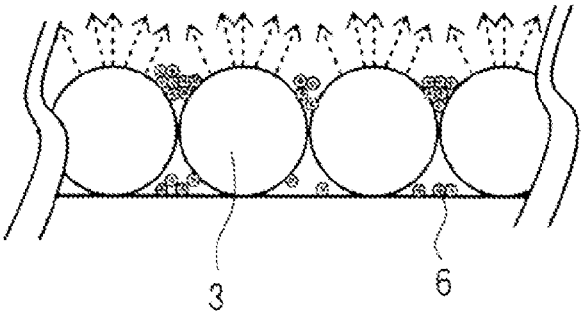
FIG. 1D is a conceptual diagram of discharge characteristics of the electro-conductive roller of the present invention.

The electro-conductive roller of the present invention is hereinafter described more specifically with reference to FIGS. 1A to 1D. FIG. 1A is a schematic perspective view illustrating an embodiment of the electro-conductive roller of the present invention. FIG. 1B is a schematic perspective view of an example of one electro-conductive polymer fiber containing electro-conductive filler. Furthermore, FIG. 1C is a schematic sectional view of the electro-conductive roller illustrated in FIG. 1A taken along a direction parallel to the axial direction of this electro-conductive roller. Moreover, FIG. 1D is a conceptual diagram of discharge characteristics of the electro-conductive roller of the present invention.

In the electro-conductive roller of the present invention, the surface layer is formed by arranging the cover layer made of polymer fibers on the outer periphery surface of the mandrel. Accordingly, as illustrated in FIGS. 1C and 1D, electro-conductive convexities are formed of the polymer fibers on the outermost part of the surface layer. Thus, even in the case where the electro-conductive roller of the present invention is used as a charging roller for electrophotography and insulators 6, such as e.g. toner and additional agent, accumulate on concavities on the outermost part formed of the polymer fibers 3 owing to usage, the electrical characteristics of the convexities are maintained as illustrated in FIG. 1D. Accordingly, the electro-conductive roller of the present invention is resistant to degradation in electrical characteristics even with long-term use, and can be used for a long term. In the case of adopting the electro-conductive roller as a charging roller, the roller can stably discharge over a long term. Broken line arrows in FIG. 1D illustrate discharge.

That is, the electro-conductive roller in the present invention can reduce abnormal electrical discharge in the axial direction of the roller and pinhole leak and be resistant to degradation in electrical characteristics even with long-term use. Accordingly, in the case of adopting the electro-conductive roller as a charging roller, unevenness in image quality is reduced, which can improve the image quality of electrophotography.

(Mandrel)

The mandrel (mandrel material) adopted in the present invention may be any appropriate material that can exert advantageous effects of the present invention. The material is not limited to specific one. The mandrel may be, for instance, an elastic roller publicly known in the field of an electrophotographic apparatus. More specifically, for instance, the roller may be a roller that includes a core rod made of metal, such as any of stainless steel, copper and tin, and a resin layer (electro-conductive layer) that contains electro-conductive carbon or another electro-conductive material and is formed on the core rod. The resin layer may be formed directly on the outer periphery surface of the core rod. Alternatively, another layer (e.g., adhesive layer) may be formed between the core rod and the resin layer. The mandrel may include a layer made of electro-conductive adhesive (gluing agent) on the surface. The surface of the mandrel may be subjected to a tacking process.

In the electro-conductive roller 1 illustrated in FIG. 1A, the polymer fibers 3 having electrical conductivity are wound in the identical direction with no gap on the outer periphery surface of the mandrel 2, which includes the core rod 2*a* at the center and the electro-conductive layer 2*b* formed on the outer periphery surface of this core rod. In other words, in the electro-conductive roller 1, the outer periphery surface of the mandrel 2 is covered with the electrode layer made of the fibers 3.

The mandrel may have electrically conductivity, which allows even a simple configuration to easily apply a voltage to the polymer fibers having electrical conductivity provided on (covering) the outer periphery surface of the mandrel. More specifically, in the case where the mandrel is connected to a power source and used, the mandrel may have an electro-resistivity of $1.0\times10^{3}$ Ωcm or more and $9.9\times10^{10}$ Ωcm or less. The mandrel having an electro-resistivity of at least $1.0\times10^{3}$ Ωcm can easily prevent current from leaking even with a thin cover of polymer fibers onto the outer periphery surface of the mandrel. The mandrel having an electro-resistivity of $9.9\times10^{10}$ Ωcm or less can easily apply a voltage to the polymer fibers covering the mandrel.

(Polymer Fibers Having Electrical Conductivity)

The polymer fibers having electrical conductivity adopted in the present invention may be any fibers that have electric conductivity and include at least one type of polymer (e.g., organic polymer). The polymer fibers may be, for instance, any appropriate electro-conductive polymer fibers conventionally publicly known in the field of electrophotographic apparatuses. The fibers are not limited to specific ones.

A specific example of the electro-conductive polymer fiber may be fibrous electro-conductive polymer (polymer itself has electrical conductivity), or a complex of conductive material and polymer (containing material for providing electrical conductivity (electro-conductive material)). The fibrous electro-conductive polymer and the fibrous complex may be appropriately combined and used as the electro-conductive polymer fibers. For instance, one electro-conductive polymer fiber 4 illustrated in FIG. 1B contains electro-conductive filler 5 as electro-conductive material. Thus, the electro-conductive polymer fibers may be any of the following modes.

Fibers made of polymer that is conductive by itself.

Fibers made of material where electro-conductive material for providing electric conductivity is mixed with polymer without electric conductivity.

Fibers made of material having electric conductivity improved by adding electro-conductive material to polymer having electric conductivity.

At least one type of fibers capable of providing electro-conductive characteristics for the electro-conductive roller can be selected and used from among these types of fibers.

The polymer fiber may contain not only polymer and electro-conductive material but also another ingredient within a range allowing the advantageous effect of the present invention to be exerted. Furthermore, to increase the surface conductivity of the polymer fibers, an electro-conductive material, such as metal or carbonaceous substances (e.g., carbon black), may be added onto the surface of the polymer fiber.

Polymer

A polymer configuring electro-conductive polymer fibers is not specifically limited only if the polymer exhibits electric conductivity by itself, such as an electro-conductive high molecular compound, or is capable of being used with an electro-conductive material to form a complex. Particularly, in desirable cases in view of improvement in uniform dispersibility, the polymer to be used with an electro-conductive material to form a complex may have affinity for the electro-conductive material to be used to form a complex.

The polymer may be, for instance, any of polyolefin polymers, such as polyethylene, and polypropylene; polystyrene; polyimide, polyamide, polyamide-imide; polyarylenes (aromatic polymers), such as polyparaphenylene oxide, poly(2,6-dimethylphenilene oxide), and polyparaphenylene sulfide; a sulfonate group (—$SO_3H$), carboxyl group (—COOH), phosphate group, sulfonium group, ammonium group or pyridinium group being introduced into polyolefin polymer, polystyrene, polyimide, and polyarylenes (aromatic polymers); fluorinated polymers, such as polytetrafluoroethylene, and polyvinylidene fluoride; perfluorosulfonic acid polymer, perfluorocarboxylic acid polymer, and perfluorophosphate polymer where a sulfonate group, carboxyl group, phosphate group, sulfonium group, ammonium group or pyridinium group is introduced into a fluorine containing polymer skeleton; polybutadiene compounds; polyurethane compounds, such as elastomer and gel; silicone compounds; polyvinyl chloride; polyethylene terephthalate; nylon; and polyarylate.

Among these materials, a single material may be used, or multiple materials may be used in a combined manner. Alternatively, a functional group is introduced, or a copolymer with another polymer may be used.

Electro-Conductive Material

For instance, a material that can provide desired electrical conductivity for polymer fibers among electro-conductive materials conventionally publicly known in the field of electrophotographic apparatuses may be appropriately adopted as the electro-conductive material that can be contained in the polymer fibers. The electro-conductive material may be, for instance, electro-conductive fine particles, or electro-conductive filler (e.g., fibrous filler). Any one or both of the electro-conductive fine particles and the electro-conductive fibrous filler may be adopted.

Specifically, the electro-conductive material may be a carbon electro-conductive material. The carbon electro-conductive material may be any of graphite, carbon black, acetylene black, Ketjenblack, active carbon fibers, and nano-carbon material.

In view of availability, any of graphite, carbon black, acetylene black, and Ketjenblack may be typically adopted from among these materials as the electro-conductive material.

Commercially available carbon black may be, for instance, TOKABLACK #4300, #4400, #4500, #5500, etc. (all of which are trade names, and furnace black manufactured by Tokai Carbon Co., Ltd.), Printex L etc. (which is a trade name and furnace black manufactured by Degussa AG), Raven 7000, 5750, 5250, 5000 ULTRA III, 5000 ULTRA, etc., Conductex SC ULTRA, Conductex 975 ULTRA, etc. (all of which are trade names, and furnace black manufactured by Columbian Co., Inc.), #2350, #2400B, #30050B, #3030B, #3230B, #3350B, #3400B, #5400B, etc. (all of which are trade names, and furnace black manufactured by Mitsubishi Chemical Corporation), MONARCH 1400, 1300, 900, Vulcan XC-72R, Black Pearls 2000, etc. (all of which are trade names, and furnace black manufactured by Cabot Corporation), Ensaco 250G, Ensaco 260G, Ensaco 350G, SuperP-Li (all of which are trade names and manufactured by TIMCAL Ltd.), Ketjenblack EC-300J, EC-600JD (all of which are trade names and manufactured by Akzo Co. Ltd.), DENKA BLACK, DENKA BLACK HS-100, FX-35 (all of which are trade names, and acetylene black manufactured by Denki Kagaku Kogyo Kabushiki Kaisha), etc. However, the carbon black is not limited thereto.

The nano-carbon material may be, for instance, carbon nanotube (CNT), carbon nanoparticles, (nano) carbon fibers, graphene, carbon whisker (vapor phase epitaxial carbon). In general, nano-carbon materials have strong cohesive power. For efficient dispersion into polymers, a process of dissolving cohesion is typically required. However, nano-carbon materials have advantages in view of electrical conductivity and specific surface.

The CNT is a carbon material made by rolling graphene (graphene sheet) into a cylinder, and has a cylindrical diameter (diameter) ranging from 1 to 10 nm. The CNTs are roughly classified into single walled nanotubes (SWCNT) and multi-walled nanotubes (MWCNT), with reference to the number of configuration circumferential walls, and various types of which are known. In the present invention, any type of carbon nanotubes that are called carbon nanotubes may be adopted.

The carbon nanoparticles are nanoscale particles ($10^{-6}$ to $10^{-9}$ m) containing carbon as the main ingredient (most major ingredient), such as carbon nanohorns, amorphous carbon, and fullerene other than the carbon nanotube. The carbon nanohorn is carbon nanoparticles which are a graphite sheet having a conically rolled shape and whose distal end is conically enclosed.

The nano-carbon fibers are configured by rolling a graphite sheet into a cylinder and have a cylindrical diameter ranging from 10 to 1000 nm. The nano-carbon fibers include carbon nanofibers. The carbon nanofiber has a fiber size of at least 75 nm and a hollow structure, and carbon fibers having many branched structures. Products thereof on the market are VGCF and VGNF, which are trade names by Showa Denko K.K.

The graphene, which is one of nano-carbon materials, is a part of a graphite structure. The graphene is an aggregate of carbon atoms where carbon six-membered rings having a flat structure are two-dimensionally arranged. That is, the graphene is made of one carbon layer.

Amounts of Blended Polymer and Electro-Conductive Material

As to polymer fibers, in view of electrical conductivity, the higher the ratio of the amount of electro-conductive material to the amount of polymer, the more desirable the characteristics are. The upper limit of the polymer content in the polymer fibers is 95% by mass. The desirable limit is 88% by mass. A polymer content of 95% by mass or less can easily eliminate difficulty in practical use in view of electrical conductivity due to relatively low content of the electro-conductive substance (electro-conductive material).

The lower limit of the polymer content in the polymer fibers is 5% by mass. In particular, the desirable limit is 60% by mass. A polymer content of at least 5% by mass can easily provide a self-forming property for the electrode layer made of polymer fibers, and easily prevent the layer from being mechanically brittle.

The desirable amount of addition (content) of the electro-conductive material in the electro-conductive polymer fibers is at least 1% by mass to the mass of electro-conductive polymer fibers. At least 1% to the mass of polymer fibers is desirable because electrical conductivity for allowing the polymer fibers to function as an electro-conductive member can be easily provided. The case of electro-conductive material content less than 1% by mass tends to exhibit insufficient electrical conductivity of the electro-conductive member in comparison with the case of at least 1% by mass.

(Degree of Orientation of Polymer Fiber)

Orientation of the electro-conductive polymer fibers adopted in the present invention with no gap in the identical direction on the outer periphery surface of the mandrel allows the outer periphery surface of the mandrel to be covered with the polymer fibers. That is, it can be said that the polymer fibers are oriented on the mandrel in the identical direction (e.g., a direction of intersecting with the axial direction of the mandrel; the desirable direction is the orthogonal direction). In the present invention, the "identical direction (same direction)" encompasses a substantially identical direction (substantially same direction) including a deviation within a range allowing the conductive roller to be provided with desired characteristics and advantageous effects in the intended orientation direction of the polymer fibers. The direction that is a desirable orientation direction and orthogonal (perpendicular direction) to the axial direction of the mandrel encompasses a "substantially perpendicular direction".

The method of arranging the polymer fibers (covering method), i.e., method of defining orientation, is not specifically limited. The publicly known technique may be appropriately used, or used in combination in some cases. For instance, in the electrospinning method illustrated in FIG. 2, a mandrel is set to a rotating jig in a state where fibers can be received on the rotating outer periphery surface to form a collector 9 (mandrel). A jet 8 of raw material liquid for polymer fibers is ejected, while the collector 9 is rotated, thereby continuously performing spinning. Thus, the electro-conductive polymer fibers arranged in a direction intersecting with (e.g., perpendicular to) the axial direction of the mandrel can significantly easily cover the outer periphery surface of the mandrel. During this process, the degree of uniaxial orientation of polymer fibers and the thicknesses of fibers can be easily controlled through control of the rotational speed of the rotating jig. For instance, as the rotational speed of the rotating jig is increased, the orientation direction of the polymer fibers can be easily and effectively aligned with a uniaxial direction (identical direction), and the thicknesses of the fibers become thinner.

The ratio of polymer fibers covering the outer periphery surface of the mandrel of the electro-conductive roller in the identical direction (uniaxial orientation) can be easily calculated as a degree of polymer orientation (%) according to the following method. That is, the electro-conductive roller is observed by a scanning electron microscope (SEM). An observed image of the electrode layer made of polymer fibers is analyzed by an analysis command "direction distribution measurement" of image processing software (trade name: A-Zou Kun manufactured by Asahi Kasei Engineering), thereby allowing the degree of polymer orientation to be calculated. More specifically, first, the inclination of the polymer fibers arranged in orientation in the desired direction on the acquired image is defined as 0°. Next, the inclinations from the polymer fibers are divided into 18 equal intervals ranging from 0° to 180° in increments of 10°, and each interval is represented by degrees. The number of fibers (degree) in each observed range (each interval) is drawn as a histogram. The degree of polymer orientation can then be acquired by the following expression. Note that the degree of polymer orientation (%) is the ratio of coverage (orientation) with polymer fibers in the same direction on the outer periphery surface of the mandrel. That is, the higher the degree of orientation is, the ratio of coverage (orientation) with the polymer fiber in the same direction on the outer periphery surface of the mandrel increases, which can be regarded as high orientation.

Degree of orientation(%)=((Number of intervals containing degrees equal to or less than half the maximum degree)/(Total number of intervals))×100 [Expression 1]

In the electro-conductive roller of the present invention, the desirable degree of orientation of polymer fibers is at least 70%. The further desirable degree is 80% or more. Furthermore, the higher the degree of orientation, the more desirable the characteristics are. In the case of a degree of orientation of polymer fiber of at least 70%, the electrical conductivity in the orientation direction is further improved. Accordingly, in the electrode layer made of polymer fibers, the surface resistivity of the electro-conductive roller in the axial direction can be at least one digit higher than the surface resistivity of the polymer fiber in the winding direction. The mechanical strength can be further improved. As a result, the electro-conductive roller that is excellent also in mechanical strength characteristics can be fabricated.

(Measurement of Electro-Resistivity of Polymer Fibers)

The electro-resistivity of the layer (electrode layer) made of the polymer fibers covering the mandrel in the axial direction of the electro-conductive roller can be measured by the following method. That is, at four points (A point, B point, C point and D point) on the surface of the electrode layer along the axial direction of the electro-conductive roller, a gold wire having a diameter of 50 μm is bonded with metal paste in order from A to D. Constant current is caused to flow through the gold wire between A and D by a constant current source, and the voltage across terminals connected between B and C is measured, thereby allowing the electro-resistivity to be measured. Likewise, the electro-resistivity of the electrode layer in the orientation direction of the polymer fiber can be measured by the following method. That is, at four points (E point, F point, G point and H point) on the surface of the electrode layer along the winding direction, a gold wire having a diameter of 50 μm is bonded with metal paste in order from E to H. Constant current is caused to flow through the gold wire between E and H by the constant current source, and the voltage across terminals connected between F and G is measured, thereby allowing the electro-resistivity to be measured.

The thickness of the electrode layer here is defined as t, and the width of the electrode layer is defined as W. The cross section S is represented as S=tW. The flowing current is defined as I, the measured voltage is defined as V, and the distance between voltage measurement terminals is defined as L. Thus, the surface resistivity (Rs) is represented as $Rs=(V/I)\times(W/L)$. The volume resistivity (ρ) is represented as $\rho=(V/I)\times(S/L)$.

(Physical Property of Polymer Fiber)

The thickness of the cover layer (electrode layer) formed of polymer fibers wound on the outer periphery surface of the mandrel may be appropriately configured within a range that does not impede the charge characteristics and discharge characteristics of the electro-conductive roller of the present invention. The thickness is not specifically limited. However, as illustrated in FIG. 1A, in the case of configuring the electro-conductive roller 1 of the present invention by covering, with the polymer fibers 3, the existing electro conductive rubber roller (mandrel 2) that includes the core rod 2*a* at the center and the electro-conductive layer 2*b* formed on the outer periphery surface of the core rod, a desirable configuration is as follows. That is, according to the desirable configuration, the stacking thickness of electrode layer is 0.1 μm or more and 5 mm or less. In the case where the stacking thickness is within this range, the outer periphery surface of the mandrel can be easily covered uniformly with the polymer fibers. This case is thus excellent in operability.

Here, the number of electro-conductive polymer fibers in any section of the electro-conductive roller (e.g., a section parallel to the axial direction of the electro-conductive roller), the interval of two adjacent electro-conductive polymer fibers (adjacent interval), and the number of stacks of electrode layers made of electro-conductive polymer fibers may be appropriately selected in conformity with the desired characteristics of the electro-conductive roller. For instance, in a section illustrated in FIG. 1C, the multiple electro-conductive polymer fibers 3 are arranged uniformly in the axial direction such that the adjacent polymer fibers are in contact with each other, and one electrode layer made of the electro-conductive polymer fibers is formed on the outer periphery surface of the mandrel 2.

As described above, the electro-conductive polymer fibers adopted in the present invention contain at least a polymer ingredient. Accordingly, the fibers necessarily have a higher resistance than that of electrode members formed of metal wires or carbon fibers themselves (typically, the conductivity of the electrode members are at least $10^4$S/cm). As a result, the electro-conductive polymer fibers adopted in the present invention have higher controllability to current than that of these electrode members. In the electro-conductive roller of the present invention, the electro-conductive polymer fibers are arranged on the outer periphery surface of the mandrel in the same direction with no gap. Accordingly, contact resistance occurs between the adjacent electro-conductive polymer fibers. Thus, in the electro-conductive roller of the present invention, the electro-resistivity of the electrode layer made of polymer fibers in the axial direction of the electro-conductive roller is necessarily higher than the electro-resistivity of the electrode layer in the orientation direction of the polymer fibers (e.g., the direction orthogonal to the axial direction of the electro-conductive roller). Such electro-conductive anisotropy cannot be acquired only by covering the mandrel with a low resistance material (conductivity: at least $10^4$S/cm), such as a metal wire. Use of polymer fibers having a higher resistance than that of such a low resistance material can achieve the anisotropy.

The sectional shape of the polymer fiber in the direction perpendicular to the fiber axial direction of the polymer fiber is not specifically limited. This shape may be, for instance, a circle, ellipse, quadrilateral, polygon, or semicircle. Alternatively, the shape may be a distorted shape (irregular shape). The shape may vary according to the section in the polymer fiber.

The polymer fiber typically has a length (length in the fiber axial direction) greater than the thickness (average fiber diameter). The desired thickness of the polymer fiber adopted in the present invention is 0.01 μm or more and less than 10 μm. The further desired thickness is less than 1 μm. The desired length of the polymer fiber is at least ten times as great as the thickness.

Here, in the case where the section of the polymer fiber is a circular shape, the thickness of the polymer fiber indicates the diameter of the circle of the section. In the other cases, the thickness indicates the length of the longest line passing through the barycenter of the section.

The polymer fibers can be identified by direct observation through scanning electron microscope (SEM) measurement. The average fiber diameter of the polymer fiber can be acquired by measuring the polymer fibers (film) in question through a scanning electron microscope (SEM), capturing an image thereof into image analysis software "trade name: Image J", then measuring the thicknesses (fiber diameters) of polymer fibers at any 50 points, and calculating the average value of the diameters.

In the case of adopting the electro-conductive roller of the present invention as the charging roller, the portion of polymer fibers serves as a charging section or a discharging section. Accordingly, the charge characteristics and discharge characteristics can be easily stabilized by densely covering the outer periphery surface of the mandrel with electro-conductive polymer fibers having a small fiber diameter, i.e., a diameter (average fiber diameter) less than 10 μm. More specifically, for instance, in the case of halftone printing at 1200 dpi, unevenness in image quality can be easily reduced.

In particular, as to the polymer fibers containing the electro-conductive material, the thinner the fiber thickness is, the better the electro-conductive material, such as electro-conductive fine particles or fibrous filler, is distributed over the entire area of being strongly stretched in the fiber axis direction (the fiber length direction) within a narrow area in the polymer fiber. Accordingly, aggregation and entanglement of electro-conductive material can be reduced, thereby improving advantageous effect of regular arrangement in the fiber axial direction (uniformly dispersed). In the case where the polymer fibers have a thickness less than 10 μm (in particular, less than 1 μm), the supramolecular array effect based on nanofiber configuration is largely exerted, the uniformly dispersing ratio of the electro-conductive material in the polymer fibers further increases, and the electrical conductivity of the acquired polymer fibers containing the electro-conductive material is further improved. That is, as to the polymer nanofibers, the thicknesses of fibers are small. Accordingly, the electro-conductive material is regularly arranged in a state where the molecular chains are significantly elongated in the inner configuration. This arrangement significantly reduces aggregation and entanglement. As a result, polymer fibers excellent in electrical conductivity can be fabricated.

Alternatively, in the case of a fiber diameter of at least 0.01 μm, the outer periphery surface of the mandrel can be easily and well covered, which is excellent in coverage.

A desired surface resistivity of the electrode layer formed of the polymer fibers in the orientation direction of the polymer fibers is $1.0\times10^{3}$ Ω/sq. or more and $9.9\times10^{14}$ Ω/sq. or less. A further desirable surface resistivity is $1.0\times10^{4}$ Ω/sq. or more and $9.9\times10^{10}$ Ω/sq. or less. If the surface resistivity is $1.0\times10^{3}$ Ω/sq. or more and $9.9\times10^{14}$ Ω/sq. or less, favorable current controllability can be easily achieved. Furthermore, in the electro-conductive roller of the present invention, the surface resistivity of the electrode layer in the axial direction of the electro-conductive roller can be higher than the surface resistivity of the electrode layer in the orientation direction of the polymer fibers. Accordingly, the electro-conductive anisotropy can be provided. In the case of adopting the electro-conductive roller as the charging roller, abnormal electrical discharge in the axial direction of the electro-conductive roller and pinhole leak can be easily controlled. Accordingly, image unevenness can be easily reduced.

In particular, in the case where the surface resistivity of the electrode layer in the axial direction of the electro-conductive roller is at least ten times as high as, that is, at least one digit higher than the surface resistivity of the electrode layer in the orientation direction of the polymer fibers, the electro-conductive anisotropy is significantly favorable. Accordingly, the advantageous effect of controlling and reducing abnormal electrical discharge in the axial direction of the electro-conductive roller and pinhole leak can be further improved. The upper limit of the surface resistivity of the electrode layer in the axial direction of the electro-conductive roller may be selected according to the desired performance of the conductive roller. For instance, the surface resistivity of the electro-conductive roller in the axial direction for achieving significantly favorable electro-conductive anisotropy is $1.0\times10^{4}$ Ω/sq. or more and $9.9\times10^{15}$ Ω/sq. or less, and is at least ten times as high as the surface resistivity in the winding direction (orientation direction of polymer fibers).

<Method of Manufacturing Electro-Conductive Roller>

The electro-conductive roller of the present invention can be manufactured by a manufacturing method comprising a step (covering step) of arranging polymer fibers having electrical conductivity on the outer periphery surface of the mandrel with no gap. In the manufacturing method, at least one of a step of fabricating a mandrel and a step of fabricating polymer fibers may be provided before the foregoing step.

(Mandrel Fabricating Step)

The mandrel adopted in the present invention can be appropriately fabricated by a conventionally publicly known method. For instance, in the case where the mandrel is an electro-conductive rubber roller that includes a core rod made of metal, such as stainless steel, and an electro-conductive layer made of resin containing an electro-conductive material, such as carbon black, and formed around (e.g., on the outer periphery surface of) the core rod, the mandrel can be fabricated by the following method, for instance. That is, the mandrel can be fabricated by forming the electro-conductive layer made of the resin around the core rod by a publicly known forming method, such as injection molding, extrusion, transfer molding, and press forming, and heating and polishing the electro-conductive layer as necessary.

(Polymer Fiber Fabricating Method)

A method of fabricating polymer fibers may be the electrospinning method, composite spinning method, polymer blend spinning method, melt-blow spinning method, and flash spinning method. The method is not specifically limited.

However, among these methods, use of the electrospinning method is favorable. The electrospinning method can easily spin various polymers into a fibrous shape. Furthermore, the shape of fiber can be relatively easily controlled. Fibers having a thickness ranging from several micrometers to nanometers can be easily acquired. Moreover, the fabricating process is significantly easy. The electrospinning method performs spinning in a state where a high voltage is applied between raw material solution for polymer fibers stored in a syringe (polymer solution) and a collector electrode. According to this method, the raw material solution pushed from the syringe is electrically charged and dispersed in an electric field to become thin lines, or polymer fibers, which adhere to the collector, thereby allowing the polymer fibers to be manufactured.

The method of fabricating raw material liquid for electrospinning is not specifically limited. A conventionally publicly known method may be appropriately adopted. For instance, in the case of adopting electro-conductive material, such as electro-conductive fine particles or fibrous filler, as one of raw materials of polymer fibers, the electro-conductive material may be dispersed and mixed using ultrasonic waves or a ball mill.

Here, the type of solvent used for raw material solution and the concentration of the solution are not specifically limited. Any condition optimal for electrospinning may be adopted.

Figure 2:
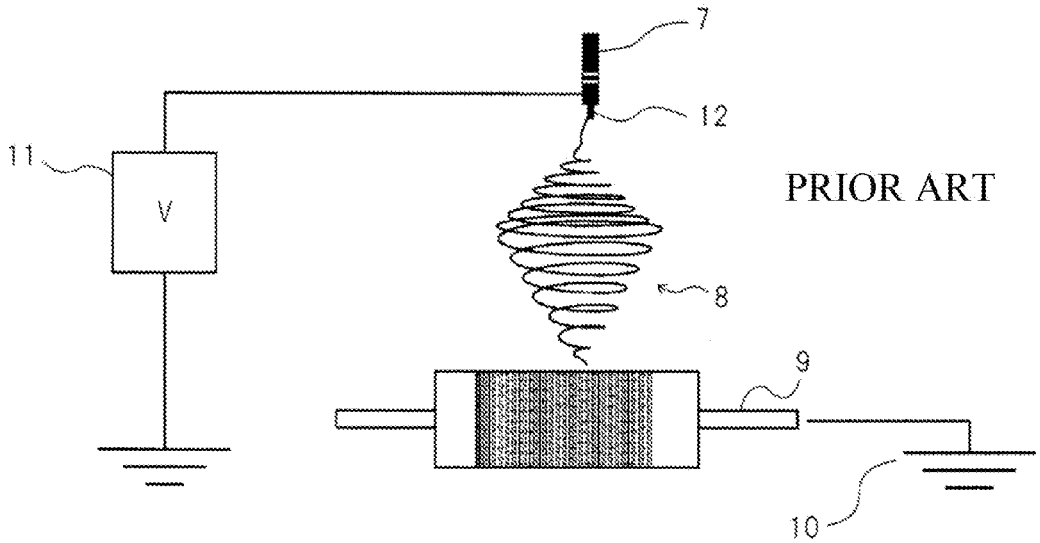
FIG. 2 is a schematic diagram for illustrating a method of manufacturing the electro-conductive roller of the present invention.
Figure 3:
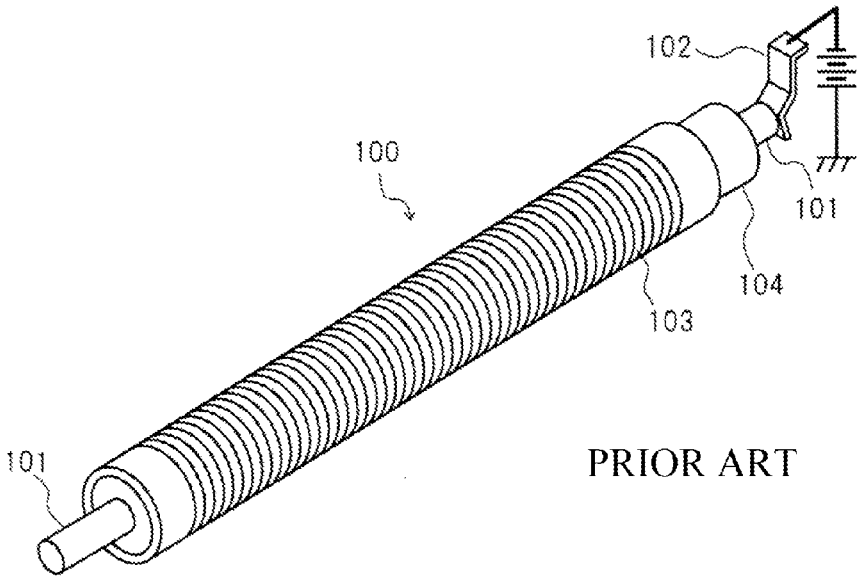
PRIOR ART FIG. 3
FIG. 3 is a schematic perspective view illustrating the electro-conductive roller disclosed in Japanese Patent Application Laid-Open No. H08-234538.

The electrospinning method is described in detail with reference to FIG. 2. As illustrated in FIG. 2, in the case of adopting the mandrel configuring the electro-conductive roller as the collector 9, only through use of this method, the method of fabricating the polymer fibers and the covering step can be performed at the same time. That is, the electrospinning method can arrange the polymer fibers on the outer periphery surface of the mandrel in the identical direction with no gap. In the present invention, the step of covering the mandrel may be performed after the step of fabricating the polymer fibers. That is, a film made of polymer fibers may be preliminarily fabricated through the electrospinning method, and the film may be used to cover the mandrel.

As illustrated in FIG. 2, the electrospinning method can be performed using a high voltage power source 11, a reservoir tank 7 that stores raw material solution, a spinning port 12, and a collector 9 connected to a ground 10.

First, raw material solution containing at least a polymer ingredient is squeezed from the tank 7 to the spinning port 12 at a constant rate. Typically, a voltage of 1 to 50 kV is applied to the spinning port 12. When the electrical attraction exceeds the surface tension of the raw material, a jet (jetted object) 8 of the raw material solution is emitted toward the collector 9 (e.g., mandrel). At this time, the solvent in the jet gradually evaporates. When the jet reaches the collector, the jet size decreases to a nanolevel. A layer (film) is then formed at the collector 9. The raw material liquid filling the reservoir tank is not limited to liquid containing the raw material dissolved in the solvent. Alternatively, a raw material that is heated to or over the melting point of the raw material and in a melting state (melted polymer) may be used.

(Covering Step)

The method of covering the outer periphery surface of the mandrel with the polymer fibers is not specifically limited. The conventionally publicly known techniques may be appropriately used, or used in combination in some cases. For instance, as described above, a method of fabricating a film where polymer fibers are arranged in a uniaxial direction and subsequently covering the mandrel with the film may be used. However, as illustrated in FIG. 2, through use of the electrospinning method where the mandrel of the electro-conductive roller of the present invention is set to a rotating jig that allows fibers to be wound and is used as the collector 9, the electro-conductive roller where the electro-conductive polymer fibers are arranged on the outer periphery surface of the mandrel in the identical direction with no gap can be directly fabricated. The method is thus excellent in operability.

The polymer fibers may be directly stacked on the mandrel. Alternatively, the fibers may be stacked and brought into contact with the outer periphery surface of the mandrel provided with an electro-conductive adhesive (gluing agent) layer on the surface, via this adhesive layer. A conventional publicly known method can be appropriately used. In the case of adopting the mandrel including the core rod at the center and the electro-conductive layer as the surface layer formed on the outer periphery surface of the core rod, the tacking process may be applied to the surface of the electro-conductive layer and subsequently the polymer fibers may be stacked. This configuration can easily improve close contact between the mandrel and the polymer fibers, and fabricate the electro-conductive roller excellent in durability. In the case of adopting the mandrel including the electro-conductive layer on the surface, the desirable polymer used as the polymer fibers may be polymer having high adherence to the electro-conductive layer. Use of the polymer having high adherence to the electro-conductive layer can easily acquire the electro-conductive roller establishing contact in a stacked manner without using the electro-conductive adhesive (gluing agent). Thus, the polymer for polymer fibers may be polymer having a polar functional group as a part of the molecular structure.

The polymer fibers configuring the electrode layer provided on the outer periphery surface of the mandrel may be made of the same material or two or more types of polymer fibers made of different materials in combination.

EXAMPLE

The present invention is hereinafter described in further detail using Examples.

Example 1

In Example 1, an electro-conductive roller was fabricated where a commercially available electro-conductive rubber roller which includes a metal rod having the outer periphery covered with an electro-conductive rubber layer having the surface subjected to the tacking process and is manufactured by CANON K.K. (φ (diameter) 12 mm, width (length in the axial direction) 250 mm, and volume resistivity ($10^5$ Ωcm)), the roller being covered with polymer fibers.

More specifically, first, DENKA BLACK (50 mg, electro-conductive material, carbon black manufactured by DENKA), and dimethylfolmamide (DMF) 1 mL were subjected to a ball mill process for 60 minutes. Subsequently, polyvinylidene fluoride-hexafluoropropylene copolymer (PVDF-HFP, manufactured by Kynar, 367 mg) dissolved in DMF was added as polymer material to treatment liquid, and a ball mill process was applied for two hours, thereby acquiring black paste diluted solution in which electro-conductive material is dispersed.

Next, according to the electrospinning method, the black paste diluted solution was jetted. Acquired polymer fibers were directly wound around the commercially available electro-conductive rubber roller attached as a rotating drum collector. More specifically, the commercially available electro-conductive rubber roller was installed as a drum rotating collector in an electrospinning apparatus (manufactured by MECC Co., Ltd.), and a tank of the electrospinning apparatus is filled with the black paste diluted solution. During lateral movement at a speed of 50 mm/s with an applied voltage of 20 kV to the spinning port, black paste diluted solution was jetted for three minutes to the commercially available electro-conductive rubber roller rotating at a rotational speed of 600 m/s in the circumferential direction. Thus, an electro-conductive roller can be easily acquired where the outer periphery surface of the mandrel (the commercially available electro-conductive rubber roller) was covered with polymer fibers containing electro-conductive material having a thickness of 10 μm in a direction substantially orthogonal to the axial direction.

The thus acquired polymer fibers had a thickness (average polymer fiber diameter) of 9 μm. According to measurement at any point on the polymer fibers on the mandrel, the degree of orientation was 83% in every case. The surface resistivity of the electrode layer made of the acquired polymer fibers was $8.00\times10^7$ Ω/sq. in the winding direction (orientation direction) of polymer fibers, and $8.10\times10^8$ Ω/sq. in the axial direction of the electro-conductive roller.

Example 2

A mixture of DENKA BLACK and carbon black manufactured by Mitsubishi at a mass ratio of 7:6 was used as the electro-conductive material. A mixture of polyamide manufactured by ARKEMA (PA12, trade name: Rilsan A) and polyamide manufactured by Daicel-Evonik Ltd. (PA610, trade name: VESTAMID Terra HS16) at a mass ratio of 40:47 was used as the polymer material. The compound ratio (pts. mass) was set to a compound ratio represented in Table 1. Other items were set in the same manner as that in Example 1. An electro-conductive roller covered with polymer fibers having a thickness of 10 μm in the identical direction was thus fabricated.

The thus acquired polymer fibers had a thickness of 80 nm. According to measurement at any point on the polymer fibers on the mandrel, the degree of orientation was 70% in every case. The surface resistivity of the electrode layer made of the acquired polymer fibers was $2.00\times10^3$ Ω/sq. in the winding direction (orientation direction) of polymer fibers, and $4.00\times10^4$ Ω/sq. in the axial direction of the electro-conductive roller.

Example 3

TOKABLACK manufactured by Tokai Carbon Co., Ltd. was used as the electro-conductive material. A mixture of polyamide manufactured by ARKEMA (PA12, trade name: Rilsan A) and polyamide manufactured by Daicel-Evonik Ltd. (PA610, trade name: VESTAMID Terra HS16) at a mass ratio of 50:13 was used as the polymer material. The compound ratio (pts. mass) was set to a compound ratio represented in Table 1. Other items were set in the same manner as that in Example 1. An electro-conductive roller covered with polymer fibers having a thickness of 10 μm in the identical direction was thus fabricated.

The thus acquired polymer fibers had a thickness of 100 nm. According to measurement at any point on the polymer fibers, the degree of orientation was 80% in every case. The surface resistivity of the electrode layer made of the acquired polymer fibers was $5.00\times10^{10}$ Ω/sq. in the winding direction (orientation direction) of polymer fibers, and $6.00\times10^{11}$ Ω/sq. in the axial direction.

Example 4

A mixture of DENKA BLACK and Ketjenblack manufactured by Lion Corporation at a mass ratio of 2:1 was used as the electro-conductive material. The compound ratio (pts. mass) was set to a compound ratio represented in Table 1. Other items were set in the same manner as that in Example 1. An electro-conductive roller covered with polymer fibers having a thickness of 10 μm in the identical direction was thus fabricated.

The thus acquired polymer fibers had a thickness of 13 μm. According to measurement at any point on the polymer fibers, the degree of orientation was 80% in every case. The surface resistivity of the electrode layer made of the acquired polymer fibers was $2.00\times10^{9}$ Ω/sq. in the winding direction (orientation direction) of polymer fibers, and $2.00\times10^{10}$ Ω/sq. in the axial direction of the electro-conductive roller.

Example 5

A mixture of DENKA BLACK and Ketjenblack manufactured by Lion Corporation at a mass ratio of 28:5 was used as the electro-conductive material. The compound ratio (pts. mass) of the materials was set to a compound ratio represented in Table 1. Other items were set in the same manner as that in Example 1. An electro-conductive roller covered with polymer fibers having a thickness of 10 μm in the identical direction was thus fabricated.

The thus acquired polymer fibers had a thickness of 2 μm. According to measurement at any point on the polymer fibers, the degree of orientation was 83% in every case. The surface resistivity of the electrode layer made of the acquired polymer fibers was $8.00\times10^{2}$ Ω/sq. in the winding direction (orientation direction) of polymer fibers, and $1.00\times10^{2}$ Ω/sq. in the axial direction of the electro-conductive roller.

Comparative Example 1

A mixture of DENKA BLACK and Ketjenblack manufactured by Lion Corporation at a mass ratio of 7:6 was used as the electro-conductive material. A mixture of polyamide manufactured by ARKEMA (PA12, trade name: Rilsan A) and polyamide manufactured by Daicel-Evonik Ltd. (PA610, trade name: VESTAMID Terra HS16) at a mass ratio of 40:47 was used as the polymer material. The compound ratio (pts. mass) was set to a compound ratio represented in Table 1. Furthermore, the rotational speed in the circumferential direction of the commercially available electro-conductive rubber roller used as a drum rotating collector in the electrospinning apparatus is changed to 5 m/s. Other items were set in the same manner as that in Example 1. An electro-conductive roller covered with polymer fibers having a thickness of 10 μm was thus fabricated.

The thus acquired polymer fibers had a thickness of 1.3 μm. According to measurement at any point on the polymer fibers, the degree of orientation was 0% (random) in every case. The surface resistivity of the electrode layer made of the acquired polymer fibers was $8.50\times10^{8}$ Ω/sq. in each of the winding direction (orientation direction) of polymer fibers and the axial direction of the electro-conductive roller. The electro-conductive anisotropy was not identified.

(Image Unevenness Evaluation)

Each of electro-conductive rollers acquired according to the Examples 1 to 5 and Comparative Example 1 is embedded as a charging roller in an electrophotographic apparatus (laser printer, trade name: LBP5400 manufactured by CANON K.K.). Endurance tests (image evaluation and performance evaluation tests) were then performed. In each test, the process speed of the electrophotographic apparatus was set to 70 mm/s, and intermittent printing of repeating an operation that outputs one image and stops the rotation of the charging roller and then restarts the image forming operation was performed at a print coverage rate of 1%, for 5000 sheets.

The test was performed in a low temperature and low humidity environment (LL environment) at 15° C./10% RH (relative humidity). In each endurance test, a halftone image was output for the 5000-th sheet. Based on this image, a state of occurrence of image unevenness (charging lateral stripes) due to abnormal electrical discharge in the axial direction of the charging roller (electro-conductive roller) and pinhole leak was evaluated. The state of occurrence was evaluated using the following evaluation standards.

A: image unevenness due to abnormal electrical discharge in the axial direction of the roller and pinhole leak is not identified.

B: occurrence of image unevenness due to abnormal electrical discharge in the axial direction of the roller and pinhole leak is significantly slight, which causes no problem in practical use.

C: image unevenness due to abnormal electrical discharge in the axial direction of the roller and pinhole leak occurs at a part of the image or over the entire image, and the image quality is low.

The following Table 1 lists the material compound ratio, the thickness and degree of orientation of polymer fiber, the surface resistivity of the electrode layer made of polymer fibers, and the evaluation result of image unevenness in the Examples and Comparative Example.

TABLE 1

| | | | Example | | | | | Comparative Example |
|---|---|---|---|---|---|---|---|---|
| | | | 1 | 2 | 3 | 4 | 5 | 1 |
| Polymer Fiber | Polymer (pts. mass) | PVDF-HFP | 88 | — | — | 88 | 67 | — |
| | | PA12 | — | 40 | 50 | — | — | 40 |

TABLE 1-continued

| | | | Example | | | | | Comparative Example |
|---|---|---|---|---|---|---|---|---|
| | | | 1 | 2 | 3 | 4 | 5 | 1 |
| | | PA610 | — | 47 | 13 | — | — | 47 |
| | Electro- | DENKA BLACK | 12 | 7 | — | 8 | 28 | 7 |
| | Conductive | Ketjenblack | — | — | — | 4 | 5 | 6 |
| | Material | Mitsubishi Carbon black | — | 6 | — | — | — | — |
| | (pts.mass) | TOKABLACK | — | — | 27 | — | — | — |
| | Surface Resistivity of Electrode Layer in Axial Direction (Ω/sq.) | | $8.10 \times 10^{8}$ | $4.00 \times 10^{4}$ | $6.00 \times 10^{11}$ | $2.00 \times 10^{10}$ | $1.00 \times 10^{2}$ | $8.50 \times 10^{8}$ |
| | Surface Resistivity of Electrode Layer in Winding Direction (Ω/sq.) | | $8.00 \times 10^{7}$ | $2.00 \times 10^{3}$ | $5.00 \times 10^{10}$ | $2.00 \times 10^{9}$ | $8.00 \times 10^{2}$ | $8.50 \times 10^{8}$ |
| | Thickness (nm) | | 9000 | 80 | 100 | 13000 | 2000 | 1300 |
| | Degree of Orientation (%) | | 83 | 70 | 80 | 80 | 83 | 0 |
| Evaluation | Image Unevenness Evaluation in LL Environment | | A | A | A | B | B | C |

As apparent in Table 1, in the case of using each of the electro-conductive rollers in Examples 1 to 5, every image unevenness evaluation result is favorable. Almost no image unevenness due to abnormal electrical discharge in the axial direction of the electro-conductive roller and pinhole leak was identified. In particular, in Examples 1 to 3, the image unevenness did not occur, and favorable images were secured.

In Example 4, the degree of orientation of polymer fibers and the surface resistivity of the electrode layer are substantially equivalent to those in Example 3. However, the diameter of polymer fiber in Example 4 is greater than that in Example 3 and also than those in Examples 1 and 2. The detailed mechanism is not identified at this point in time. It can, however, be considered that since dense coverage can be significantly favorably achieved with the polymer fibers having a fiber diameter less than 10 μm as in Examples 1 to 3, the abnormal electrical discharge in the axial direction of the electro-conductive roller and pinhole leak can be favorably controlled and reduced.

The electro-conductive rollers in Examples 1 to 3 have a higher surface resistivity of the electrode layer than that of Example 5. In particular, the difference between surface resistivities of the electrode layer in the axial direction of the electro-conductive roller and the winding direction of the polymer fibers is at least one digit. That is, as the electrical resistance of polymer fibers increases, the contact resistance between adjacent polymer fibers increases. This increase, in turn, increases the difference between surface resistivities of the electrode layer in the axial direction of the electro-conductive roller and the winding direction of the polymer fibers. As a result, favorable electro-conductive anisotropy occurs. In particular, it can be identified that the difference between surface resistivities of at least one digit is significantly effective in reducing and eliminating abnormal electrical discharge in the axial direction of the electro-conductive roller and pinhole leak.

(Durability Evaluation of Electro-Conductive Roller)

(1) Preparation of Evaluation;

(Smear Adherence Enhancing Step)

Each of the electro-conductive rollers acquired according to Examples 1 to 3 was attached as a charging roller to a process cartridge for a laser printer manufactured by HP (trade name: Color Laser Jet 3800), and the process cartridge was inserted into the laser printer. Next, the laser printer continuously output 50 sheets of monochrome solid images in a standard temperature and humidity environment (25° C., 50% RH) and subsequently processed one sheet of a white solid image. This process was repeated six times to output total 300 sheets of monochrome solid images. Subsequently, the process cartridge was removed from the laser printer, and the electro-conductive roller according to each Example was removed from the process cartridge. This step was for forcing toner and additional agent to adhere to the surface of the electro-conductive roller according to each Example.

(2) Image Output Step (2-1) Preparation of Image Output;

Each of the electro-conductive rollers according to Examples acquired in the foregoing step (1) was attached as a charging roller to a process cartridge for a laser printer converted based on the laser printer (trade name: Color Laser Jet 3800, manufactured by HP), and the process cartridge was inserted into the converted laser printer.

The converted laser printer is for A4 portrait output. The printer was converted to have two types of process speeds of a recording medium, 200 and 100 mm/second, and an image resolution of 600 dpi. Furthermore, the printer was converted so as to perform primary charging by applying at a DC voltage of −1100 V across the charging roller and the electrophotographic photosensitive member. The converted laser printer output the following images.

(2-2) Image Forming Step;

First, one sheet of a halftone image for evaluation (an image where lateral lines with a width of one dot were drawn at two-dot intervals in the direction perpendicular to the rotational direction of the photosensitive member) was output. This halftone image is regarded as an "evaluation image 1".

After output of the "evaluation image 1", an image on which lateral lines having a width of two dots were drawn at 50-dot intervals in the direction perpendicular to the rotational direction of the photosensitive member and which had a print concentration of 4% was adopted as an output image. Image forming was performed and 3000 sheets were output in a mode called an intermittent mode where the rotation of the electrophotographic photosensitive member is stopped at each output of one image. After forming the image on the 3000-th sheet, a sheet of a halftone image for evaluation was output. This halftone image is regarded as an "evaluation image 2".

After output of the "evaluation image 2", the power of the laser printer was turned off, and 12 hours thereafter the power was turned on, and another sheet of a halftone image for evaluation was output again. This halftone image is regarded as an "evaluation image 3".

After output of "evaluation image 3", 3000 sheets were output again in the intermittent mode. After forming the image on the 3000-th sheet, a sheet of a halftone image for evaluation was output. This halftone image is regarded as an "evaluation image 4".

After output of the "evaluation image 4", the power of the laser printer was turned off, and 12 hours thereafter the power was turned on, and another sheet of a halftone image for evaluation was output again. This halftone image is regarded as an "evaluation image 5".

The "evaluation image 1", "evaluation image 2", "evaluation image 3", "evaluation image 4" and "evaluation image 5" were visually inspected whether concentration unevenness having a fine stripe shape caused by charging unevenness occurred or not.

The foregoing (2-2) image forming step was performed multiple times in different image output environments and process speeds, as listed in the following Table 2.

TABLE 2

| Evaluation Pattern | Environment | Process Speed |
|---|---|---|
| I | Low Temperature and Low Humidity Environment: 15° C./10% RH | 200 mm/second |
| II | Standard Temperature and Standard Humidity Environment: 23° C./50% RH | " |
| III | High Temperature and High Humidity Environment: 30° C./80% RH | " |
| IV | Low Temperature and Low Humidity Environment: 15° C./10% RH | 100 mm/second |
| V | Standard Temperature and Standard Humidity Environment: 23° C./50% RH | " |
| VI | High Temperature and High Humidity Environment: 30° C./80% RH | " |

As a result, in the case of using each of the electro-conductive rollers fabricated in Examples 1 to 3 according to the present invention, any stripe-shaped concentration unevenness (lateral stripe) image was not identified at all for each of the evaluation patterns 1 to VI. Accordingly, it has been apparent that the electro-conductive roller according to the present invention has high durability.

As described in each Embodiment, the present invention can provide the electro-conductive roller that can reduce abnormal electrical discharge in the axial direction of the roller and pinhole leak and be resistant to degradation in electrical characteristics.

The specific examples have thus been described above in detail. However, these examples are only for exemplifying purpose, and do not limit the scope of claims. The techniques described in claims include various modifications and changes of the above exemplified specific examples.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-202658, filed Sep. 27, 2013, which is hereby incorporated by reference herein in its entirety.

What is claimed is:

1. An electro-conductive roller for applying a charge to a member in order to provide a charged member, comprising:

a mandrel; and an electrode layer made of a polymer fiber having an electro-conductivity, the polymer fiber being wound around a periphery of the mandrel and covering a peripheral surface of the mandrel, said polymer fiber being aligned in a circumferential direction of the mandrel, wherein the electrode layer has a surface resistivity in an axial direction of the electro-conductive roller of at least ten times as high as a surface resistivity of the electrode layer in the circumferential direction of which the polymer fiber is aligned, and no electrical gap exists between the polymer fiber of the electrode layer such that a direct electrical discharge is prevented between the mandrel and the charged member.

2. The electro-conductive roller according to claim 1, wherein the layer has a surface resistivity in the circumferential direction of $1.0\times10^{3}$ to $9.9\times10^{14}$ Ω/sq.

3. The electro-conductive roller according to claim 1, wherein the polymer fiber comprises at least one member selected from the group consisting of an electro-conductive fine particle and a fibrous filler having an electro-conductivity.

4. A method of manufacturing the electro-conductive roller according to claim 1, comprising a step of fabricating the polymer fibers by an electrospinning method.

5. The electro-conductive roller according to claim 1, wherein the polymer fiber comprises polyvinylidene fluoride-hexafluoropropylene copolymer and carbon black as an electro-conductive material.

6. The electro-conductive roller according to claim 1, wherein the polymer fiber comprises polyamide and carbon black as an electro-conductive material.

* * * * *